United States Patent [19]

Paulus et al.

[11] 4,231,812

[45] Nov. 4, 1980

[54] SURFACE TREATMENT OF METAL STRIP

[75] Inventors: Philippe Paulus, Liege; Jules Hancart, Jupille, both of Belgium

[73] Assignee: Centre de Recherches Metallurgiques-Centrum voor Research in de Metallurgie, Brussels, Belgium

[21] Appl. No.: 20,196

[22] Filed: Mar. 13, 1979

[30] Foreign Application Priority Data

Mar. 14, 1978 [BE] Belgium ..... 864899

[51] Int. Cl.[2] ..... C23F 7/10; C21D 1/60

[52] U.S. Cl. ..... 148/6.15 R; 148/6.15 Z; 148/143

[58] Field of Search ..... 148/6.15 Z, 6.15 R, 148/143, 18; 252/71

[56] References Cited

U.S. PATENT DOCUMENTS

| | | | |
|---|---|---|---|
| 1,761,186 | 6/1930 | Baker et al. | 148/6.15 Z |
| 2,800,422 | 7/1957 | Piccinelli | 148/6.15 Z |
| 2,813,813 | 11/1957 | Ley et al. | 148/6.15 Z |
| 2,857,301 | 10/1958 | Mauzy et al. | 148/18 |
| 2,984,592 | 5/1961 | Logan | 148/6.15 R |
| 3,520,738 | 7/1970 | Matsubara et al. | 6.15 R/ |
| 3,573,997 | 4/1971 | Plaxton | 148/6.16 |

FOREIGN PATENT DOCUMENTS

| | | | |
|---|---|---|---|
| 880445 | 10/1961 | United Kingdom . | |
| 1018215 | 1/1966 | United Kingdom . | |
| 1076678 | 7/1967 | United Kingdom . | |
| 1198546 | 7/1970 | United Kingdom | 148/6.15 Z |

*Primary Examiner*—Ralph S. Kendall

*Attorney, Agent, or Firm*—Holman & Stern

[57] ABSTRACT

Metal strip, particularly steel strip, is heated to above 250° C. and quenched in a phosphating bath, at 80° C. or more, containing one or more phosphates of the type Me $(H_2PO_4)_n$, where Me=Zn, Ni, Mn, or an alkali metal, at a concentration of 1 to 20 g/l.

17 Claims, 1 Drawing Figure

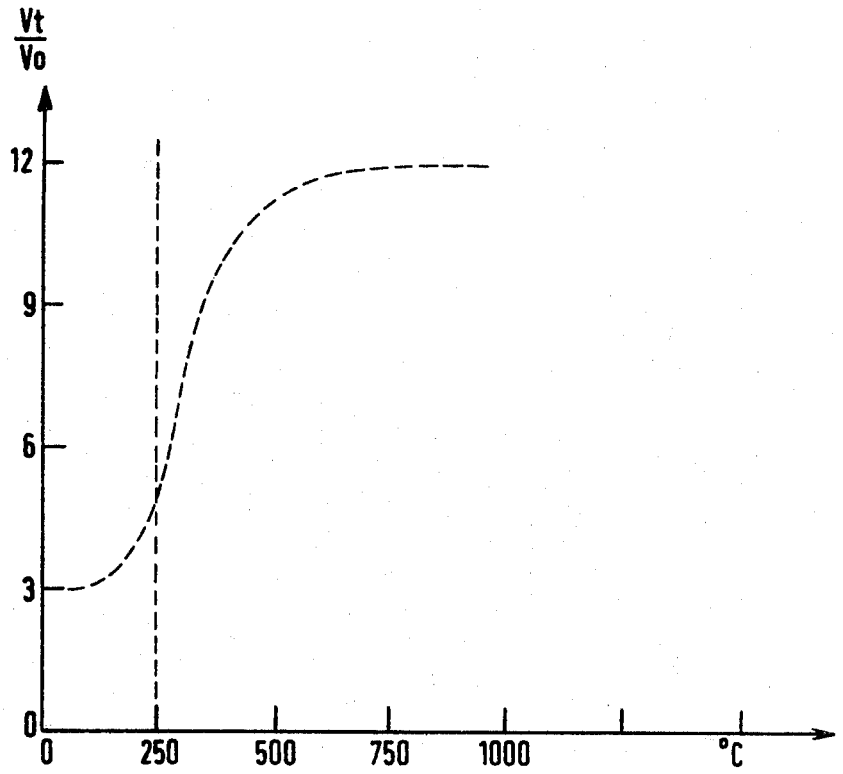
Vt/Vo
12
9
6
3
0
0
250
500
750
1000
°C

SURFACE TREATMENT OF METAL STRIP

BACKGROUND OF THE INVENTION

1. Field of the Invention

The present invention relates to a method of coating metal strip with phosphate film, in particular steel strip for deep drawing, during a thermal treatment. The range of applications of the process which consists in coating a metal sheet, in particular a steel sheet, with a protective film, such as a phosphate film, is very wide; for example this film may be used as:

a temporary protection of the surface between manufacture and use:

a base layer which is advantageous for subsequent adhesion of a final protective layer:

a preparatory layer before painting:

a layer which is advantageous for adhesion of the lubricant before forming.

2. Description of the Prior Art

These multiple applications only differ from one another by the thickness and the type of the protective film to be deposited, in particular the phosphate film.

We have already advocated a method for continuous thermal treatment of steel strip elsewhere. The method consists in heating the sheet to a temperature higher than its recrystallization temperature and then cooling it rapidly by immersing it in an aqueous bath held at a temperature higher than 75° C. and preferably substantially at its boiling point.

We have also disclosed the possibility of combining this thermal treatment with a subsequent surface treatment designed to coat the strip with a metallic or phosphate film.

SUMMARY OF THE INVENTION

The present invention is, based on the fact that, during tests, we observed that the deposition rate of the phosphate increases considerably when, instead of introducing the cold strip into the bath, it is preliminarily heated to a temperature higher than 250° C. This quite unexpected fact enables the metal strip to be coated with a relatively thick film in a very short time.

BRIEF DESCRIPTION OF THE DRAWING

In the accompanying drawing the sole FIGURE shows the development of the deposition rate $V_T$ (relative to the rate $V_o$ at room temperature) as a function of the temperature of the strip on entering a bath constituted by a phosphating solution comprising 8 g/l of $NaH_2PO_4$ and phosphoric acid ($H_3PO_4$) at a pH of the order of 4.7 and at a temperature of 97° C. It is observed that the deposition rate attained is greatly increased when the strip is preheated before being introduced into the bath. Moreover, using such a bath enables the complete avoidance of the oxidation of the strip which normally takes place when a strip is quenched from a temperature higher than 500° C. in, for example, distilled water.

DESCRIPTION OF THE PREFERRED EMBODIMENTS

On the basis of these considerations, the present invention provides a method which comprises the following steps:

(a) the strip is heated to a temperature higher than 250° C., preferably higher than 300° C. and preferably under a protective atmosphere if the heating temperature is higher than 500° C.

(b) the strip is quenched in a bath having a temperature higher than or equal to 80° C., preferably higher than or equal to 90° C., and containing one or more phosphates of the type $Me(H_2PO_4)_n$ where Me may be Zn, Ni, Mn, alkali metal, at concentrations of 1 to 20 g/l, preferably of 5 to 15 g/l; this bath may also possibly contain an inorganic acid, preferably of the phosphoric type, a reaction accelerator of the molybdate type, and a non-foaming detergent agent. The pH of the solution is advantageously in the range from 3 to 6.

During treatment of strip, sufficient quantities of phosphating salts are added to prevent depletion of the bath. The metal strip to be coated may be steel strip.

The coating of the strip may be implemented during a thermal treatment in which the strip is introduced into a hot aqueous solution in order to rapidly cool it after recrystallization treatment and where it is possibly then introduced into a further hot aqueous solution for its final cooling after thermal overaging treatment, one or other of these solutions being used as a phosphating bath.

We have developed operating modes which enable the thickness and the properties of the phosphate film to be regulated when required.

According to a first operating mode, in the case in which a film having a low thickness and a high phosphate content is required, a single immersion for a period of 0.5 to 40 seconds is required.

In the case in which the phosphating operation is combined with heat treatment comprising quenching after recrystallization heating, but without tempering (for example for a steel having a high tensile strength), the phosphating is carried out at the time of the said quenching.

From these considerations a specific treatment for strip for deep-drawing may be established, this treatment comprising the following steps;

(a) heating to a temperature higher than the recrystallization temperature of the strip and holding at this temperature for a sufficient period, this being carried out under a protective atmosphere;

(b) quenching in a phosphating bath as disclosed above, the said bath being at a temperature higher than or equal to 80° C. with a holding time of 0.5 to 40 seconds at a temperature lower than 150° C.;

(c) very careful rinsing of the strip after it has left the bath;

(d) tempering or overaging consisting in heating the sheet to a temperature of 300° to 500° C.

According to a first variant, the final cooling is carried out in a well-known customary manner, such as, for example, by pressure gas jets.

According to a second variant, in the case in which a film which is highly protective against corrosion is required, the strip is again quenched in a passivating solution containing, for example, a mixture of $Cr^{3+}$-$Cr^{6+}$ after the overaging treatment.

We claim:

1. A method of treating the surface of a steel strip and coating it with a phosphate layer, during thermal treatment which comprises quenching after recrystallization, the method comprising the following steps:

(a) heating the strip to a temperature higher than the recrystallization temperature and holding at this temperature; and (b) quenching the strip in a phosphating bath having a temperature of at least 80° C. and containing at least one phosphate of the type $Me(H_2PO_4)_n$, where Me is selected from Zn, Ni, Mn, and alkali metals, at a concentration in the range 1 to 20 g/l.

2. A method as claimed in claim 1, in which the said temperature to which the strip is heated is higher than 500° C. and the heating is performed under a protective atmosphere.

3. A method as claimed in claim 1, in which the temperature of the phosphating bath is at least 90° C.

4. A method as claimed in claim 1, in which the phosphate concentration is in the range 5 to 15 g/l.

5. A method as claimed in claim 1, in which the bath contains an inorganic acid.

6. A method as claimed in claim 1, in which the bath contains a reaction accelerator of the molybdate type.

7. A method as claimed in claim 1, in which the bath contains a non-foaming detergent.

8. A method as claimed in claim 1, in which the pH of the bath is 3 to 6.

9. A method as claimed in claim 1, further comprising adding at least one said phosphate to the bath to maintain the phosphate concentration in the said range.

10. A method as claimed in claim 1, in which the quenching consists of a single immersion for a period of 0.5 to 40 seconds.

11. A method as claimed in claim 1, effected during a thermal treatment which comprises quenching after the recrystallization heating, but without tempering, the phosphating bath being used for the said quenching.

12. A method as claimed in claim 1, in which the quenched strip is non-tempered.

13. A method as claimed in claim 1, in which the quenched strip is subjected to thermal overaging treatment.

14. A method as claimed in claim 13, comprising the following steps:

(a) heating to a temperature higher than the recrystallization temperature and holding at this temperature, under a protective atmosphere;

(b) quenching in the phosphating bath, the said bath being at a temperature of at least 80° C., with a residence time of 0.5 to 40 seconds at a strip temperature lower than 150° C.;

(c) rinsing of the strip on emerging from the bath; and (d) overaging tempering consisting in heating the strip to a temperature of 300° to 500° C.

15. A method as claimed in claim 14, further comprising, after the overaging treatment, quenching the strip in a passivating solution.

16. A method as claimed in claim 13, in which the thermal overaging treatment comprises heating the strip to at least 300° C., further comprising subsequently quenching the strip in a further said phosphating bath.

17. A method of treating the surface of a steel strip and coating it with a phosphate layer, during thermal treatment, comprising introducing the strip into a first hot aqueous solution in order to rapidly cool it after recrystallization treatment and then introducing the strip into a second hot aqueous solution in order to finally cool it after a thermal overaging treatment, the second aqueous solution is a phosphating bath having a temperature of at least 80° C. and containing at least one phosphate of the type $Me(H_2PO_4)_n$, where Me is selected from Zn, Ni, Mn, and alkali metals, at a concentration in the range 1 to 20 g/l.

* * * * *